United States Patent [19]

Cribben et al.

[11] 4,437,284

[45] Mar. 20, 1984

[54] SNAP-ON FALSE MUNTIN SYSTEM

[75] Inventors: James T. Cribben, Mechanicsburg; William J. Ichter, Camp Hill, both of Pa.

[73] Assignee: Capitol Products Corporation, Mechanicsburg, Pa.

[21] Appl. No.: 175,127

[22] Filed: Aug. 4, 1980

[51] Int. Cl.[3] ..... E06B 3/70

[52] U.S. Cl. ..... 52/456; 52/311

[58] Field of Search ..... 52/456, 455, 311, 717

[56] References Cited

U.S. PATENT DOCUMENTS

| | | | |
|---|---|---|---|
| 1,789,280 | 1/1931 | Armstrong . | |
| 3,358,412 | 12/1967 | Martin | 52/456 |
| 3,411,258 | 11/1968 | Nessler | 52/311 X |
| 3,678,651 | 7/1972 | Hicks | 52/311 |
| 3,708,939 | 1/1973 | Herr | 52/456 |
| 3,748,814 | 7/1973 | Cribben | 52/668 |
| 3,843,475 | 10/1974 | Kent | 52/717 X |
| 3,913,293 | 10/1975 | Bischoff, Jr. | 52/456 |
| 3,946,531 | 3/1976 | Armstrong | 52/456 |
| 4,145,858 | 3/1979 | Dovman | 52/456 |
| 4,296,583 | 10/1981 | Egenlauf | 52/717 |

*Primary Examiner*—Carl D. Friedman

*Attorney, Agent, or Firm*—Donald L. Johnson; John F. Sieberth; Paul H. Leonard

[57] ABSTRACT

A false muntin assembly for converting a single window pane into one having multiple lights by having a muntin bar of desired outside appearance with a central hole and channel lengthwise along the back of the muntin bar, using pin connectors at intersections and in the peripheral sash and adhering snap-fit metal clips to the glazing panel in line with the false muntin design to prevent the false muntin from floating away from the pane.

8 Claims, 11 Drawing Figures

SNAP-ON FALSE MUNTIN SYSTEM

BACKGROUND OF THE DISCLOSURE

This invention relates in general to the building materials industry, and more particularly, is directed to a false muntin assembly for removably affixing a false muntin to a single glazing panel in a window to achieve the effect of multiple lights.

In view of the constantly rising costs in the building materials industry, it has become increasingly important for builders and material supply men to find suitable methods and substitute materials which may be employed in building construction to replace existing conventional materials and methods in order to effect economies in building construction without undue sacrifice in quality of construction and in the appearance of the finished product.

Particularly, in the manufacture of windows used primarily in residential construction, savings are now being realized in the fabrication of window sash by employing a single pane of glass and by eliminating the use of individual horizontal and vertical muntin bars and other window dividers. Window manufacturers have found that increased fabricating costs and increased labor costs result from the use of muntin bars and divided light windows. Accordingly, most producers have now almost universally changed fabrication methods to produce window sashes of various sizes having but a single light of glass. In this manner, a considerable manufacturing cost savings can be realized to thus continue to make such windows competitive in the building field by completely eliminating the expense of manufacturing and installing individual muntin bars and individual panes of glass in the sash.

In addition, newer methods of manufacture have resulted in procedures wherein glaziers can be almost entirely eliminated by utilizing wrap-around glazing and various vinyl plastic window sealing materials whereby no putty or other sealing materials will be required. In this manner, it is now possible to produce and assemble window units without former labor delays in glazing and without the expense occasioned by the previous individually glazing of a multiplicity of panes within a multilight sash. In instances wherein metal sash is employed, glass is now applied to the frame by utilizing hard vinyl or soft vinyl peripheral retaining strips, thereby also further reducing labor costs and the need for skilled glaziers.

Even though the initial cost savings realized in the new methods of manufacture have indeed been significant, the advantages gained are somewhat offset by the fact that the windows so produced all look alike and the individual characteristics of design that were available with prior art models can no longer be produced using the present methods. In order to offset this shortcoming, the use of removable type muntin bar assemblies fabricated either of wood or of a vinyl resin plastic has become increasingly more popular. The plastic and wood decorative window grill assemblies as presently manufactured usually comprise a plurality of intersecting grill bars, means to interconnect the individual grill bars to the window frame. Various methods have been employed by prior workers in the art to removably affix the decorative window grill assemblies over a single light of glass, for example, by using collar pins as disclosed in U.S. Pat. No. 3,358,412 to Martin. In another method, an offset connector is used to removably affix decorative window grills over a single light window sash, U.S. Pat. No. 3,708,939, to Herr. Further, Hicks, U.S. Pat. No. 3,678,651, has a partial false muntin assembly having a window divided into two lights by a glazing bead and a false muntin having a rigid, continuous aluminum base and vinyl semi-rigid cover with a snap-fit interlock to form the false muntin. U.S. Pat. No. 3,748,814 to Cribben shows a crosslap type joint for false muntin assembly in which two cross pieces of hollow rectangular tubular metal are interlocked by bending one of them at the joint to form a rectangular or parallelogram patterned grid.

One of the primary problems with false muntins is their tendency to bow away from the glazing panel when positioned in between the sashes or glazing beads of window. Bischoff, Jr. in U.S. Pat. No. 3,913,293 teaches a hollow false muntin grid with a reinforcing rod bowed towards the glass plate surface to force the hollow false muntin assembly into contact with the glass. Other attempts to overcome this have placed the false muntin bars within the hollow space between the two panes of an insulated glass in order to give a uniform appearance from inside and outside and to reduce the lifting away or floating of the false muntin system from the glazing panel, see Armstrong, U.S. Pat. No. 3,946,531. More recently, Dovman, in U.S. Pat. No. 4,145,858, has placed his tubular rectangular muntin bars for a window grille construction in between the glazing panels of the double glazed window and connected them together at their ends by use of a spring biased clip inserted into the hollow mitered extremities of paired members. This clip, however, is designed not to be easily removed or removable from the muntin bars.

The present invention provides a false muntin assembly which does not have the float problem and which can be snap-fit onto the glazing panel and removed therefrom for more easily cleaning the window panel.

SUMMARY OF THE INVENTION

The present invention advantageously overcomes the problems of prior art false muntin systems. The objects and features of the invention hereinabove indicated, as well as others, will be more clearly evident from the following description. According to the present invention, there is provided a false muntin assembly for a window having a peripheral sash, a glazing pane with a single light and a glazing bead holding said glazing pane in position in said sash comprising (a) an extruded false muntin bar having a central hole and channel extending into the hole from the back side of said bar and at its apex slightly narrower than the diameter of said central hole, said bar being shaped at its end to fit either the glazing bead or an intersection with another said bar, (b) a pin connector which fits the ends of said bar for connection of said bar with either the glazing bead or another said bar at an intersection, and (c) a metal clip having a head, two angularly spaced-apart legs projecting therefrom, each leg ending in a flange, said clip being adapted to snap-fit its head in the channel and central hole of said bar so that when said clip is adhered to the glazing panel in proper alignment said false muntin assembly is releasably attachable thereto and forms a multi-light effect.

DESCRIPTION OF THE PREFERRED EMBODIMENTS

Figure 8:
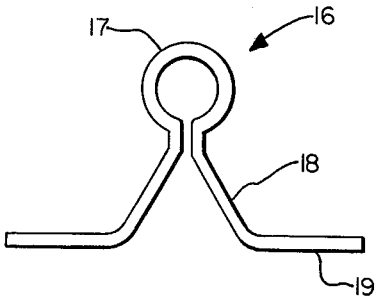
FIG. 8 shows an end view of a highly preferred embodiment metal clip employed in the present invention.
Figure 9:
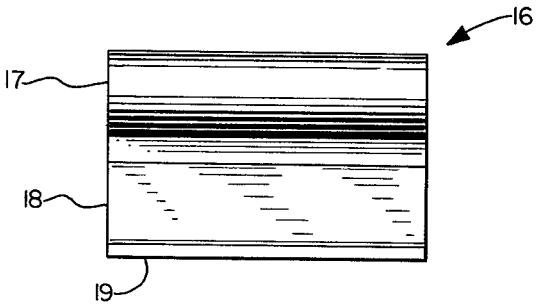
FIG. 9 shows a side view of the metal clip of FIG. 8.
Figure 10:
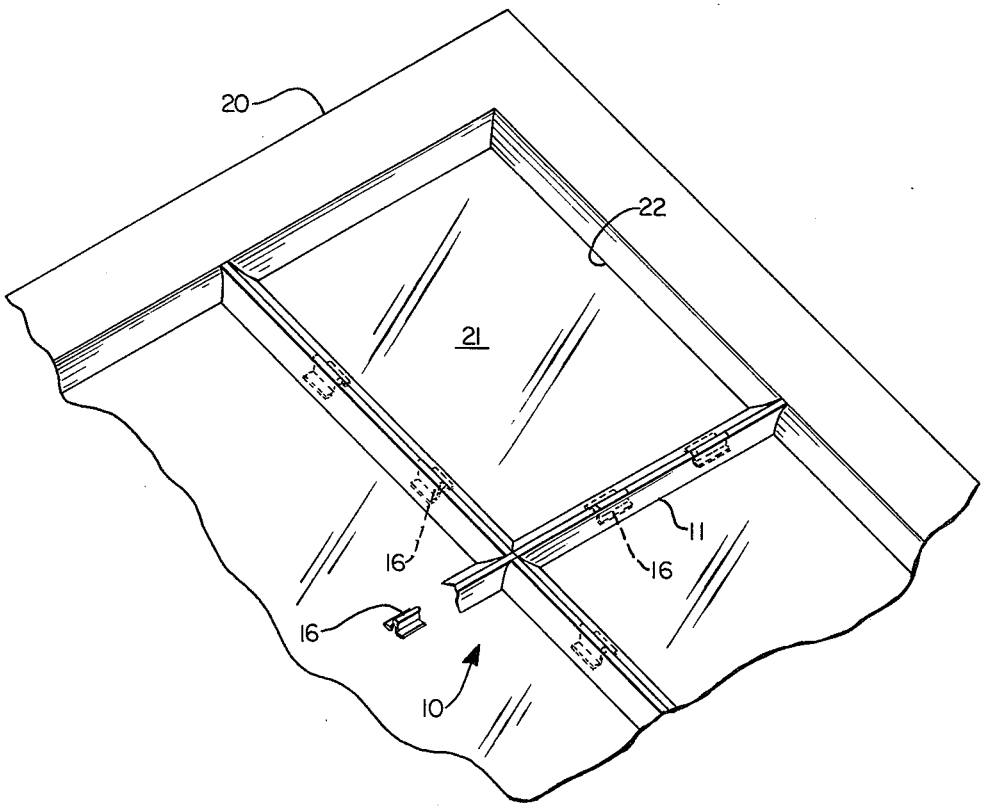
FIG. 10 shows a partial view of the window sash having the false muntin assembly of the present invention in place upon the glazing panel with a partial cutaway view of the horizontal muntin bar showing a metal clip employed in the assembly in place.
Figure 11:
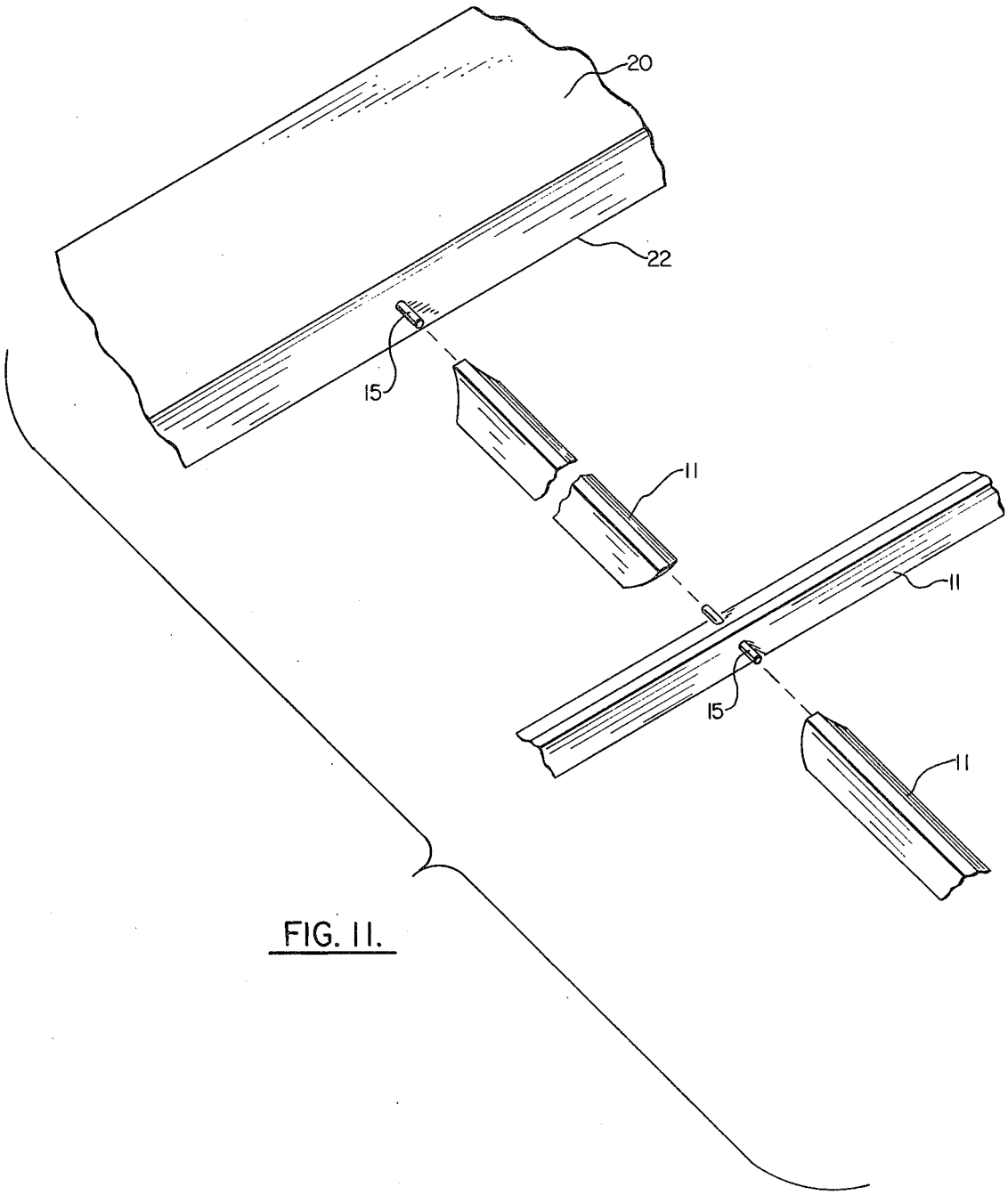
FIG. 11 shows an exploded view depicting the connections at the glazing bead and the intersection of the muntin bars.

The false muntin assembly of the present invention can be more particularly described with respect to the various figures of the drawings in which like numerals are used in each figure to represent like parts. As shown in FIGS. 1–5, the false muntin assembly 10 of the present invention has as the main component thereof an extruded muntin bar 11. This extrusion can take the outward appearance of any architectural style desired such as without limitation, Colonial, Georgian, Old English, diamond lites, etc. The ends of the muntin bar 11 can be suitably cut, shaped or machined to fit the glazing bead 22 (see FIG. 10) or form an intersection with another extruded muntin bar 11. The backside of the muntin bar 11 shows a central longitudinal hole 12 connected to a channel 13 open to the backside of the muntin bar 11. The central hole 12 is somewhat larger than channel 13 and channel 13 provides an opening to the central hole 12. Stepped flange 14 provides a flat footing on the glazing panel with the channel 13 opening up to a base portion 23 which fits over metal clip 16 as shown in FIGS. 8 and 9. The muntin bar 11 can be drilled normal to its main axis to receive connector pin 15. Connector pin 15 fits into the central channel 12 on the end of another muntin bar which is cut or shaped to fit precisely against the side of the muntin bar 11, thus forming an intersection. Glazing bead 22 can also have a suitable hole formed therein for receiving a connector pin 15, see FIGS. 10 and 11, and complete the attachment of muntin bar 11 to the glazing bead. Such pin attachments are known in the prior art, see U.S. Pat. No. 3,358,412 to Martin.

Metal clip 16 has head 17 which is shown in FIG. 8 and is of a circular nature but does not form a complete circle. Instead, it ends in two legs 18 spaced-apart from each other and connected to head 17. Said legs 18 end in flanges 19. In a preferred embodiment of the metal clip 16, the flanges 19 are normal to a plane which bisects clip 16 vertically and is equidistant from legs 18. Thus, flanges 19 of metal clip 16 are flat and usually fit into and are sized to fit behind stepped flanges 14 of muntin bar 11. Head 17 easily fits into central hole 12 and is held in place by the constriction of channel 13. Thus, when assembled into the desired configuration such as in FIG. 10, clips 16 are snapped in place in muntin bars 11, spread with a suitable adhesive and the false muntin assembly 10 is affixed in place over glazing bead connector pins 15 in sash 20. Upon curing of the adhesive and adherence of the metal clips 16 to glazing panel 21, slight pressure gripping of the false muntin bar is sufficient to pop it off or unsnap it from clip 16 and allow removal of the false muntin system from the glazing panel 21 for subsequent cleaning thereof.

Figure 1:
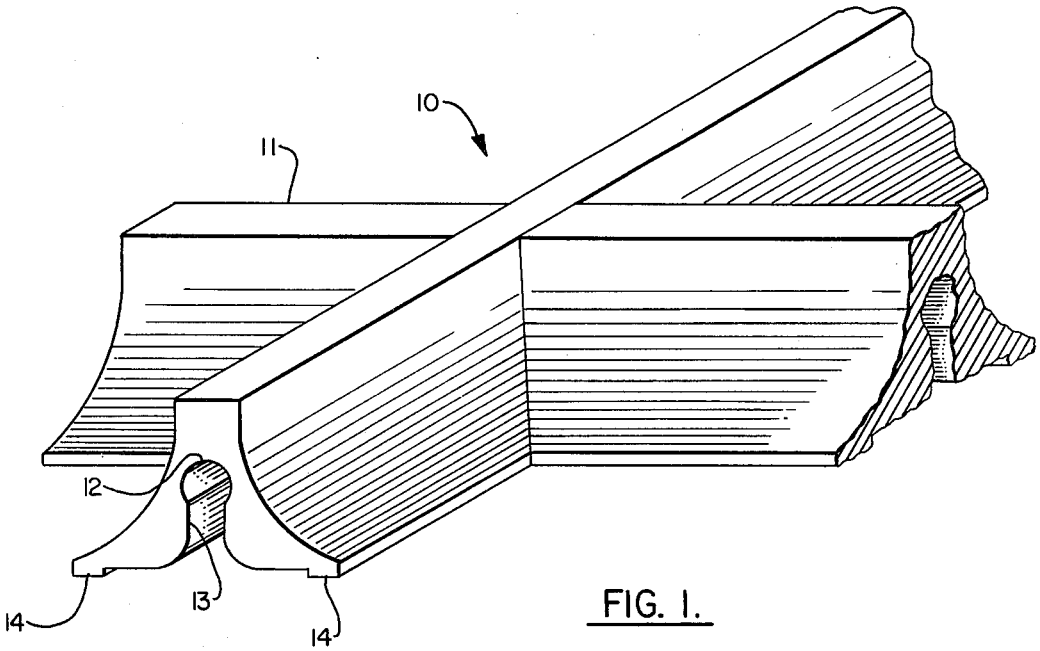
FIG. 1 represents a partial perspective view of an assembled false muntin system.
Figure 2:
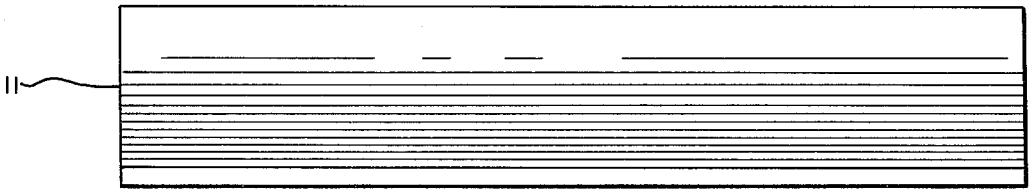
FIG. 2 is a side view of a false muntin bar according to the present invention.
Figure 3:
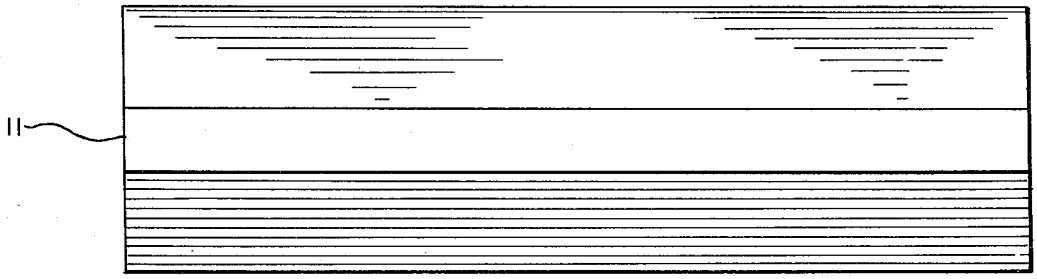
FIG. 3 is a top view of a preferred embodiment of a false muntin bar according to the present invention.
Figure 4:
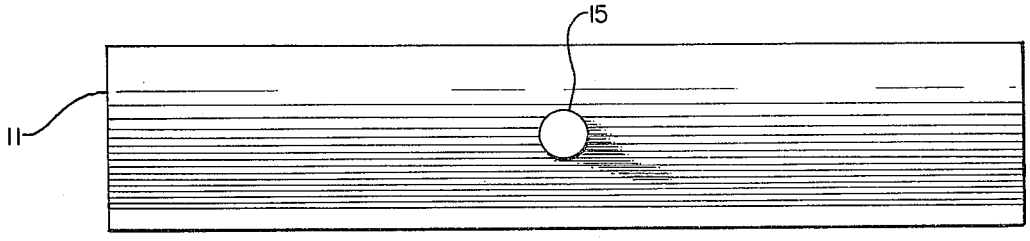
FIG. 4 shows a side view of a horizontal false muntin bar containing the connector pin.
Figure 5:
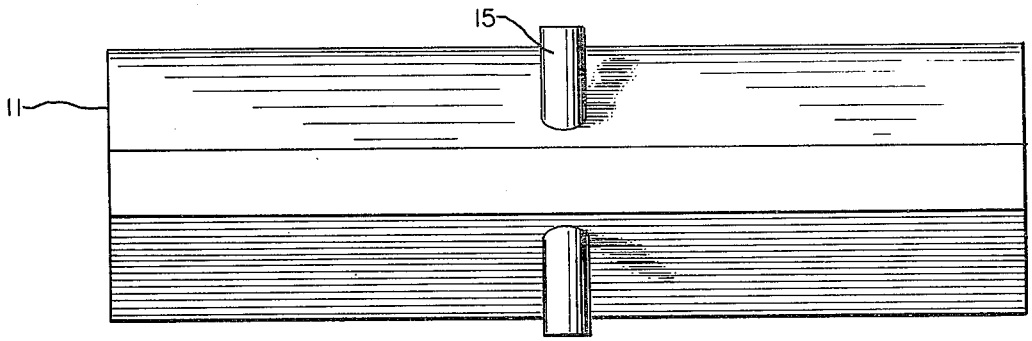
FIG. 5 shows a top view of a preferred embodiment of the false muntin bar with a connector pin in place.
Figure 6:
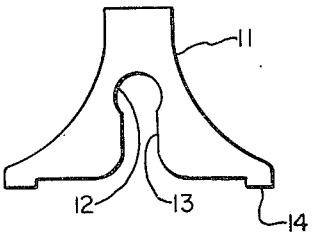
FIGS. 6 and 7 show end views of preferred and alternate embodiments of the false muntin bar of the present invention.
Figure 7:
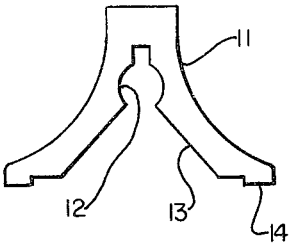

The materials of construction of the present invention can be widely varied as befits the uses intended. Muntin bar 11 can be extruded in various external shapes and have various internal configurations, note FIGS. 6 and 7. It is preferably extruded from plastic or light metal such as aluminum. In other cases, it can also be machined from wood. The clip 16 is referred to as a metal clip; however, it is clearly intended that it could be prepared from metal such as steel or aluminum, plastic or other structural material. Its shape, like that of the muntin bars 11 can vary such that it could have flanges 19 turned inwardly, it could be of solid bar stock machined to the desired shape, or it could have a non-circular head. The connector pin 15 is well known in the art and can be tapered, splined, and constructed of wood, metal or plastic. It should be noted that when in place the connector pin 15 can be snapped on to the false muntin bar 11 exactly in the same manner as clip 16.

Accordingly, having described the present invention it is recognized that various changes and modifications within the scope and spirit of the invention can be made by one skilled in the art. It is, therefore, accordingly desired that the invention be limited only by the lawful scope of the following claims.

What is claimed:

1. A false muntin assembly for a window having a peripheral sash, a glazing pane with a single light and a glazing bead holding said glazing pane in position in said sash comprising (a) an extruded false muntin bar having a central hole and channel extending into the hole from the back side of said bar and at its apex slightly narrower than the diameter of said central hole, said bar being shaped at its end to fit either the glazing bead or an intersection with another said bar, (b) a pin connector disposed in the central hole of the ends of said bar for connection of said bar with either the glazing bead or another said bar at an intersection, and (c) a metal clip having a head, two angularly spaced-apart legs projecting therefrom, each leg ending in a flange, said clip being adapted to snap-fit its head in the channel and central hole of said bar whereby said pin connector and clip can be snapped on in substantially the same manner so that when said clip is adhered to the glazing panel in proper alignment said false muntin assembly is releasably attached thereto and forms a multi-light effect.

2. The false muntin assembly of claim 1 in which a false muntin bar is positioned horizontally on the glazing pane and is continuous and an intersecting false muntin is positioned vertically on the glazing pane and is non-continuous.

3. The false muntin assembly of claim 2 wherein said horizontally positioned muntin bar has a hole drilled therethrough with said pin connector fitted therein at the point of intersection with the vertically positioned muntin bar.

4. The false muntin assembly of claim 1 in which said central hole in said extruded false muntin bar is circular therethrough and opens out into said channel.

5. The false muntin assembly of claim 1 in which the head of the metal clip is circular and slightly smaller than the central hole of the false muntin bar but larger than the apex of the channel extending into said central hole.

6. The false muntin assembly of claim 1 in which said metal clip has the flanges at the end of its spaced-apart legs, disposed in a plane normal to the plane bisecting said clip, and equidistant from said legs at all points.

7. The false muntin assembly of claim 1 in which said false muntin bar has a stepped flange adapted to fit over the flange of said metal clip so that said false muntin bar appears to adhere directly to said glazing panel.

8. The false muntin assembly of claim 1 having the snap-in metal clips adhered to said glazing panel in proper alignment so that proper intersection and division of said glazing panel into multiple lights is accomplished when said false muntin assembly is snapped on to said metal clips.

* * * * *